US007654427B1

(12) United States Patent
Tsai et al.

(10) Patent No.: US 7,654,427 B1
(45) Date of Patent: Feb. 2, 2010

(54) SUCTION ROLLER AND TRANSPORTING APPARATUS USING THE SAME

(75) Inventors: Chih-Jen Tsai, Taitung County (TW); Chang-Chou Li, Tainan (TW); Chung-Hsin Hsiao, Chiayi County (TW)

(73) Assignee: Industrial Technology Research Institute, Hsin-chu (TW)

( * ) Notice: Subject to any disclaimer, the term of this patent is extended or adjusted under 35 U.S.C. 154(b) by 0 days.

(21) Appl. No.: 12/267,789

(22) Filed: Nov. 10, 2008

(30) Foreign Application Priority Data

Sep. 18, 2008 (TW) ..... 97135870 A

(51) Int. Cl.
*B65H 20/00* (2006.01)
*B65H 23/24* (2006.01)

(52) U.S. Cl. ..... 226/95; 226/20; 242/615.11

(58) Field of Classification Search ..... 226/95, 226/97.3, 15, 20; 242/615.11
See application file for complete search history.

(56) References Cited

U.S. PATENT DOCUMENTS 3,549,098 A * 12/1970 Koskela et al. ..... 242/542.4
3,587,962 A * 6/1971 Herzhoff et al. ..... 226/95
4,328,626 A * 5/1982 Leitner ..... 34/115
4,888,848 A * 12/1989 Serracant-Clermont et al. ..... 15/309.1
4,919,319 A * 4/1990 Ford et al. ..... 242/615.12
5,087,313 A * 2/1992 Duecker ..... 156/271
5,104,489 A * 4/1992 Beisswanger et al. ..... 162/369
5,114,062 A * 5/1992 Kuhn et al. ..... 226/95
5,232,141 A * 8/1993 Mittmeyer et al. ..... 226/95
5,358,163 A * 10/1994 Naka ..... 226/95
5,489,784 A * 2/1996 Koiranen et al. ..... 250/548
5,554,262 A * 9/1996 Turner ..... 162/198
5,915,648 A * 6/1999 Madrzak et al. ..... 242/615.2
5,931,635 A 8/1999 Barthold et al.
6,004,432 A * 12/1999 Page et al. ..... 162/281
6,038,976 A * 3/2000 Helmstadter et al. ..... 101/410
6,250,581 B1 * 6/2001 Cramer ..... 242/541.7
6,328,194 B1 * 12/2001 Meschenmoser ..... 226/95
6,364,247 B1 * 4/2002 Polkinghorne ..... 242/615.11
6,427,941 B1 8/2002 Hikita et al.
6,488,194 B1 * 12/2002 Couturier ..... 226/95
6,739,489 B1 * 5/2004 Nicolai et al. ..... 226/95
6,786,449 B2 * 9/2004 Marcle-Geler et al. . 242/615.12
7,025,303 B2 * 4/2006 Meyer ..... 242/615.12
7,311,234 B2 * 12/2007 Solberg ..... 226/97.3
7,383,772 B2 * 6/2008 Boppel et al. ..... 101/228
2002/0113164 A1 * 8/2002 Marcle-Geler et al. . 242/615.12
2006/0097101 A1 * 5/2006 Boppel et al. ..... 242/615.12
2006/0261120 A1 * 11/2006 Slyne ..... 226/95
2007/0102563 A1 * 5/2007 Kubota et al. ..... 242/548
2008/0176728 A1 * 7/2008 Scheu ..... 492/8

* cited by examiner

*Primary Examiner*—Evan H Langdon
(74) *Attorney, Agent, or Firm*—Rabin & Berdo, P.C.

(57) ABSTRACT

The present invention provides a suction roller which is capable of being adopted for sucking an object. The suction roller is provided with a negative pressure inside thereof and at least one opening for sucking the object by at least one valve disposed in each opening respectively for selectively controlling the on-off of the negative pressure through the opening. During the rotation of the suction roller, the valves in a specific area are capable of being opened so that the negative pressure can pass through the openings with respect to the opened valve to suck the object and transport the object subsequently. In another embodiment, the present invention also provides a transporting apparatus combining the suction roller and a guiding mechanism for transporting the object and compensating the shifting during the moving of the object.

27 Claims, 11 Drawing Sheets

SUCTION ROLLER AND TRANSPORTING APPARATUS USING THE SAME

FIELD OF THE INVENTION

The present invention relates to a transporting apparatus, and more particularly, to a transporting apparatus configured with a suction roller for enabling an object to be transported along with the rotation of the suction roller as the object is adhered to the rotating suction roller.

BACKGROUND OF THE INVENTION

Following the advance of technology, the development of consumer products is progressing as well for meeting the ever-changing requirements of our modern lifestyle. Thus, by the advantages of its flexibility, portability, capability of being rolled up and low cost, flexible electronic products such as flexible display may be the trend of the future. As such products are made from flexible materials; a roll-to-roll (R2R) transporting device is most likely to be adopted in its manufacturing process and is becoming the key device to be improved for perfecting the manufacturing process.

In general, those flexible electronic products, especially the flexible display, are produced by a complex manufacturing process which usually is composed of a plurality of manufacturing procedures. During the operating of such manufacturing process when a substrate of the flexible product is transported from one manufacturing procedure to the next manufacturing procedure, the substrate must be effectively confined for achieving higher accuracy, especially in the stacking and alignment procedures. However, when a roll-to-roll device is adopted in the manufacturing process for transporting the substrate, some form of substrate shifting is inevitable. Therefore, certain guidance system such as a drift corrector should be adopted in the manufacturing process for rectifying the substrate shifting. However, when the drift corrector is applied on a semi-product, i.e. a substrate being processed by a portion of the R2R manufacturing process including wet coating, frame glue coating and medium filling, it is inevitable that the drift corrector will cause the roller to contact with the flexible substrate and thus contaminate the substrate or even cause structural damage on the substrate. As the substrate is transported from one manufacturing procedure to the next manufacturing process for producing the flexible device, any careless handling or pressing during the transportation will cause some sort of damage to the substrate and thus adversely affect the yield of the final product.

In addition, as the flexible substrate is being transported continuously in the manufacturing process, it is usually being processed by a surface processing procedure right after it is being rectified by a drift corrector, and then before the curing of the surface processing, it must be rectified again for preparing the same for the next manufacturing procedure. As such, no matter the rectification is performed by shaking the substrate or enabling the substrate to drift sideways, it is impossible to prevent the roller from contacting with the flexible substrate and thus the production quality of such continuous manufacturing process is adversely affected.

Therefore, for preventing any damage to the flexible substrate during transportation, it is vital for the R2R device to be able to exert a stable confining force upon the thin film substrate for effectively controlling the movement of the same with regard to its transportation, position rectification, tension, and so on. In the conventional R2R manufacturing process, there are several methods being developed for preventing the roller from contacting with the substrate. One of which is executed by recessing the middle portion of the roller for shaping the same similar to a dumbbell. Thereby, when the dumbbell-shaped rollers are used in the R2R device for transporting the substrate, it will only have contact to the substrate by the two bulging ends thereof while preventing the recess portion thereof from contacting with the substrate so that the middle portion of the substrate is not touched by the roller as it is being transported. Another method is performed by forming respectively a plurality of via holes at the two longitudinal sides of the substrate while spacing any two neighboring via holes by a specific interval; and correspondingly, form a plurality of dots on the surface of the roller respectively and linearly at the two ends thereof. Thereby, when the roller is driven to rotate, the dots will inset into their corresponding via holes for driving the substrate to move accordingly and the same time that the moving substrate is confined by the dots inset in the via holes, which is similar to the way how a roll of paper is being rolled and moved in the conventional dot matrix printers.

Except for the aforesaid methods, there is another way for preventing the roller from contacting the substrate, which is a web transporting method and apparatus disclosed in U.S. Pat. No. 6,427,941. In the aforesaid web transporting apparatus, the roller is formed with a plurality of jetting holes on the whole periphery thereof, through which, as the roller is charged with positive air pressure, air is jetted on the web for floating the web in a manner that a smaller air gap is formed between the web and the transporting surface of the roller, and thus the substrate is prevented from contacting directly with the roller. Moreover, different from the aforesaid roller charged with positive pressure, there is another roller using suction for transporting the substrate, as the one disclosed in U.S. Pat. No. 5,931,635. Wherein, the circumferential surface of the roller is covered by a layer consisting of a resilient material. The resilient layer positioned on the circumferential surface of the roller includes a number of suction cups. The roller is designed as a hollow roller which includes a mechanical device by which the suction cups in the resilient layer on the circumferential surface of the roller can be operated by partial deformation of said resilient layer. It is noted that the mechanical device can be two different wheels formed with respective elongate protrusions that are received inside the hollow roller while enabling the protrusions to contact with the interior of the roller intermittently as the wheels are rotating.

SUMMARY OF THE INVENTION

The object of the present invention is to provide a suction roller, capable of exerting a stable confining force in a specific area for securely holding an object by suction while controlling gas from leaking out of the specific suction area and also preventing the cause of any damage to the manufacturing surface of the object, through which the object can be transported from one procedure to another procedure in a manufacturing process while its movement with regard to its transportation, position rectification, tension are effectively controlled.

Another object of the invention is to provide a transporting apparatus, which not only is configured with a suction roller to be used for securely holding an object by suction, but also is configured with a position adjustment unit to be used for compensating the shifting during the moving of the object and thus achieving a specific position accuracy.

In an exemplary embodiment of the invention, the present invention provides a suction roller, which comprises: a sleeve, having a plurality of first via holes formed thereon; an outer wheel, being received inside the sleeve and having a plurality of second via holes formed thereon at positions corresponding to the plural first via holes while configuring a valve inside each second via hole; and an inner wheel, being received inside the outer wheel and configured with a protrusion and at least a slot in a manner that the protrusion is separated from the inner wall of the outer wheel by a minute gap.

In another exemplary embodiment of the invention, the present invention provides a transporting apparatus, which comprises: at least a suction roller, each being mounted on a base to be used for transporting an object and each further being comprised of: a sleeve, having a plurality of first via holes formed thereon; an outer wheel, being received inside the sleeve and having a plurality of second via holes formed thereon at positions corresponding to the plural first via holes while configuring a valve inside each second via hole; and an inner wheel, being received inside the outer wheel and configured with a protrusion and at least a slot in a manner that the protrusion is separated from the inner wall of the outer wheel by a minute gap; a negative pressure source, coupled to the at least one suction roller for providing a negative pressure thereto; and a position adjustment unit, coupled to the base for adjusting the position thereof and thus compensating the shifting during the transporting of the object.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention and wherein.

DESCRIPTION OF THE EXEMPLARY EMBODIMENTS

For your esteemed members of reviewing committee to further understand and recognize the fulfilled functions and structural characteristics of the invention, several exemplary embodiments cooperating with detailed description are presented as the follows.

Figure 1A:
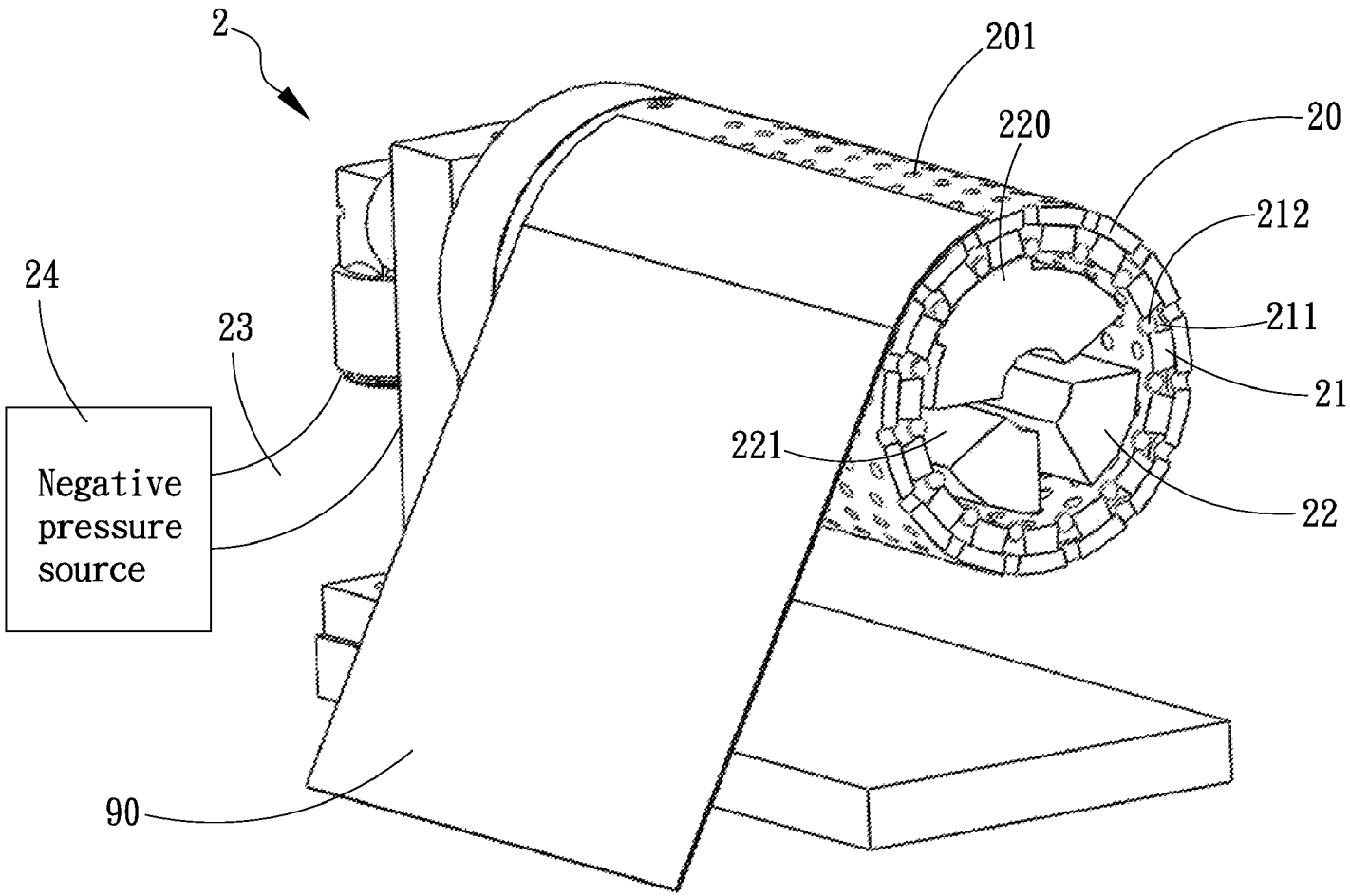
FIG. 1A is a three-dimensional view of a suction roller according to an exemplary embodiment of the invention.
Figure 1B:
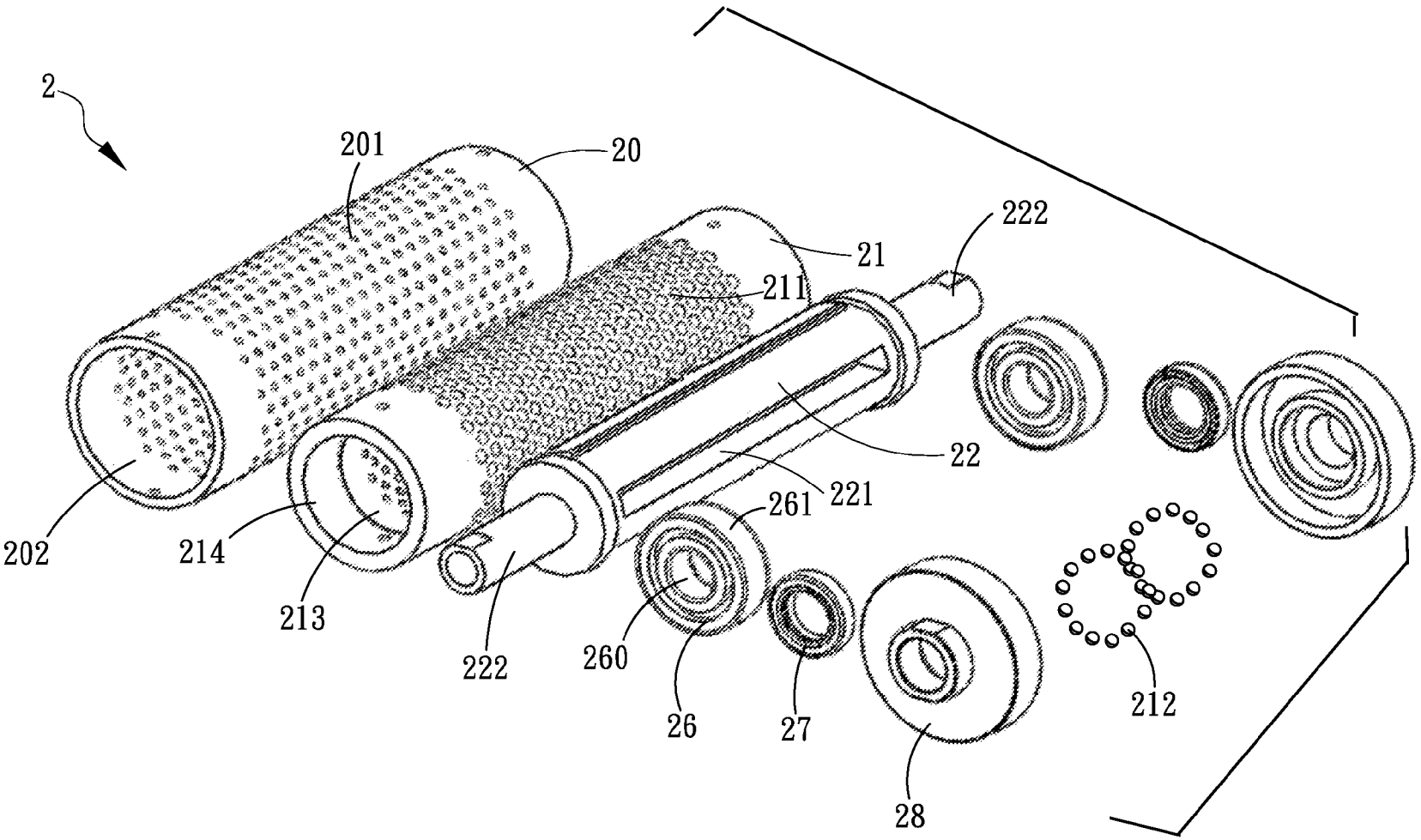
FIG. 1B is an explode view of a suction roller according to an exemplary embodiment of the invention.
Figure 2B:
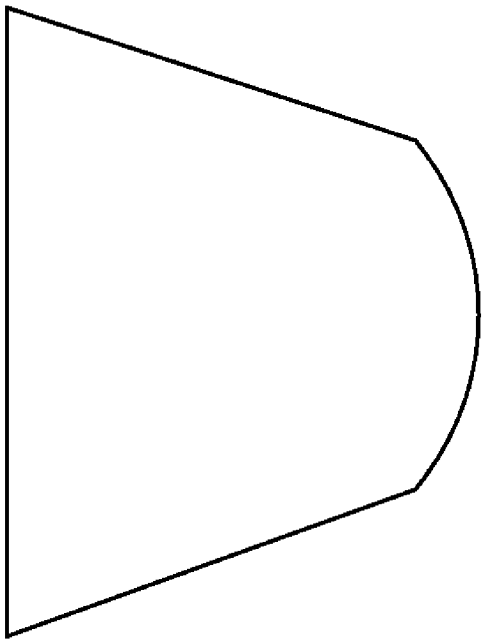
FIG. 2A and FIG. 2B are schematic diagrams showing shapes of the valves being adopted in the suction roller of the invention.
Figure 2A:
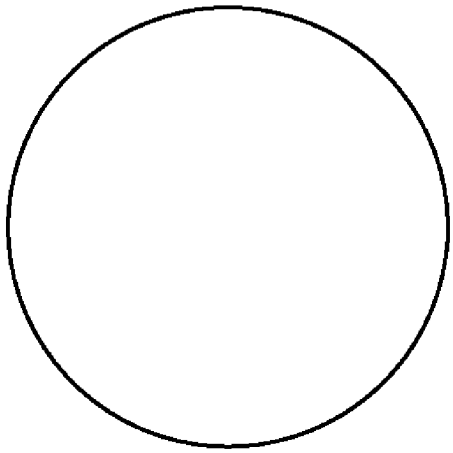

Please refer to FIG. 1A and FIG. 1B, which are a three-dimensional view and an exploded view of a suction roller according to an exemplary embodiment of the invention. In this exemplary embodiment, the suction roller 2 is designed to exert suction on an object 90 for transporting the object 90 along with the rotation of the suction roller 2. In this embodiment, the object 90 can be made of a material selected form the group consisting of: a soft material and a flexible material. The aforesaid suction roller comprises: a sleeve 20, an outer wheel 21 and an inner wheel. The sleeve 20 is configured with an accommodation space 202 and a plurality of first via pin holes 201. In FIG. 1, each of the first via pin holes 201 is shaped like a circle. The sleeve 20 can be made of steel, glass, ceramics, fibers or plastics. The outer wheel 21, being received inside the accommodation space 202, is formed with an accommodation space 213 and a plurality of second via holes 211, in which the plural second via holes is formed on the outer wheel 21 at positions corresponding to the first via pin holes 201 while each being configuring with a valve 212 therein. It is noted that the valves 212 shown in FIG. 1B are only for illustration that only a portion of the valve 212 fitted in the plural second via holes 211 is shown in FIG. 1B. In this embodiment, each of the second via holes 211 is a cone-shaped hole. For preventing the valve 212 from dropping out from the first via pin holes 201 during the rotation of the outer wheel 21, the aperture of the first via pin holes 201 is formed smaller than the outermost aperture of the second via hole 211. Please refer to FIG. 2A and FIG. 2B, which are schematic diagrams showing shapes of the valves being adopted in the suction roller of the invention. For matching with the shape and size of the second via holes 211, the valve 212 can be formed as a ball or as a cone, as those shown in FIG. 2A and FIG. 2B. In addition, the valve 212 is made of a material selected from the group consisting of: steel, glass, ceramics, fibers and plastics.

Figure 3A:
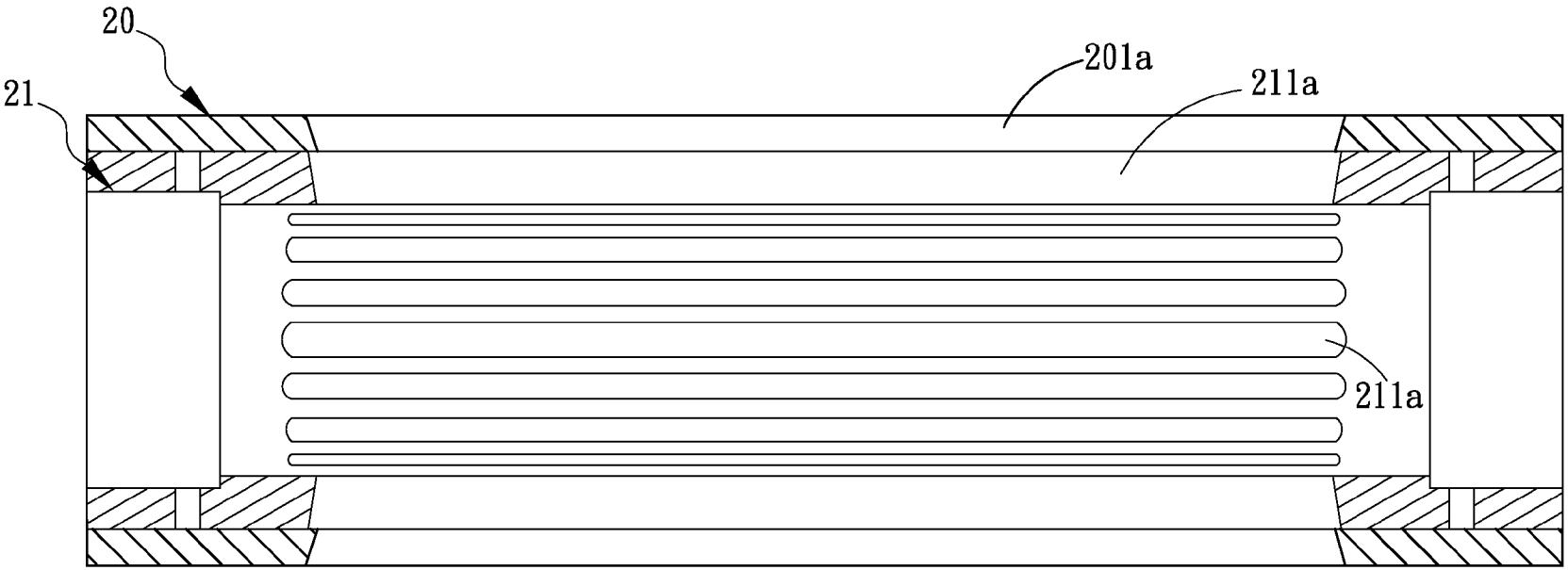
FIG. 3A is a cross sectional view of an outer wheel being adopted in the suction roller according to an exemplary embodiment of the invention.
Figure 3C:
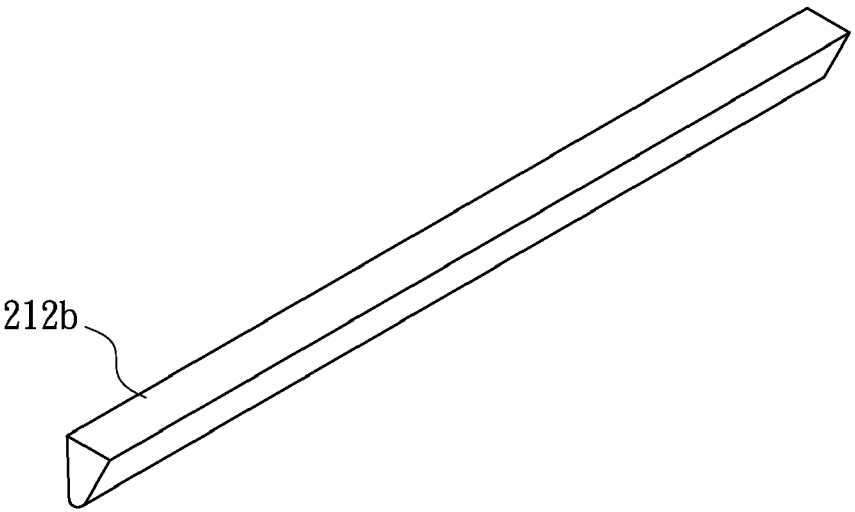
FIG. 3B and FIG. 3C are three-dimensional diagrams showing the valves being adopted in the suction roller according to an exemplary embodiment of the invention.
Figure 3B:
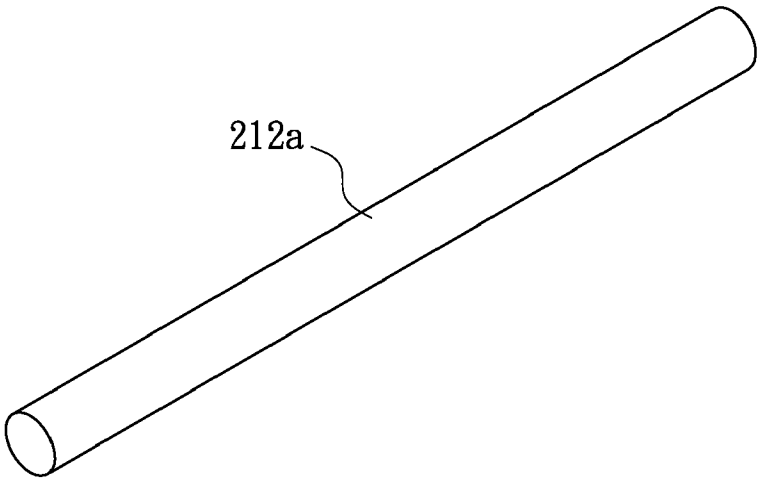

Please refer to FIG. 3A, which is a cross sectional view of an outer wheel being adopted in the suction roller according to an exemplary embodiment of the invention. In this embodiment, the second via holes 211*a* formed on the outer wheel 21 is not shaped like a circular hole, but is an elongated cone-shaped hole. Therefore, for matching with such elongated cone-shaped second via holes 211*a*, the valves, each valve can be a column 212*a*, as the one shown in FIG. 3B, or a cone cylinder 212*b*, as the one shown in FIG. 3C, so as to be received into its corresponding second via hole 211*a* for controlling the on-off of the same. When the second via holes 211*a* are elongated cone-shaped holes, as those shown in FIG. 3A, the first via pin holes 201 should be also being shaped as elongated holes 201*a* whose width should be smaller that that of the second via hole 211*a* for preventing the valve from dropping out from the first via holes 201*a* during the rotation of the outer wheel.

Figure 4:
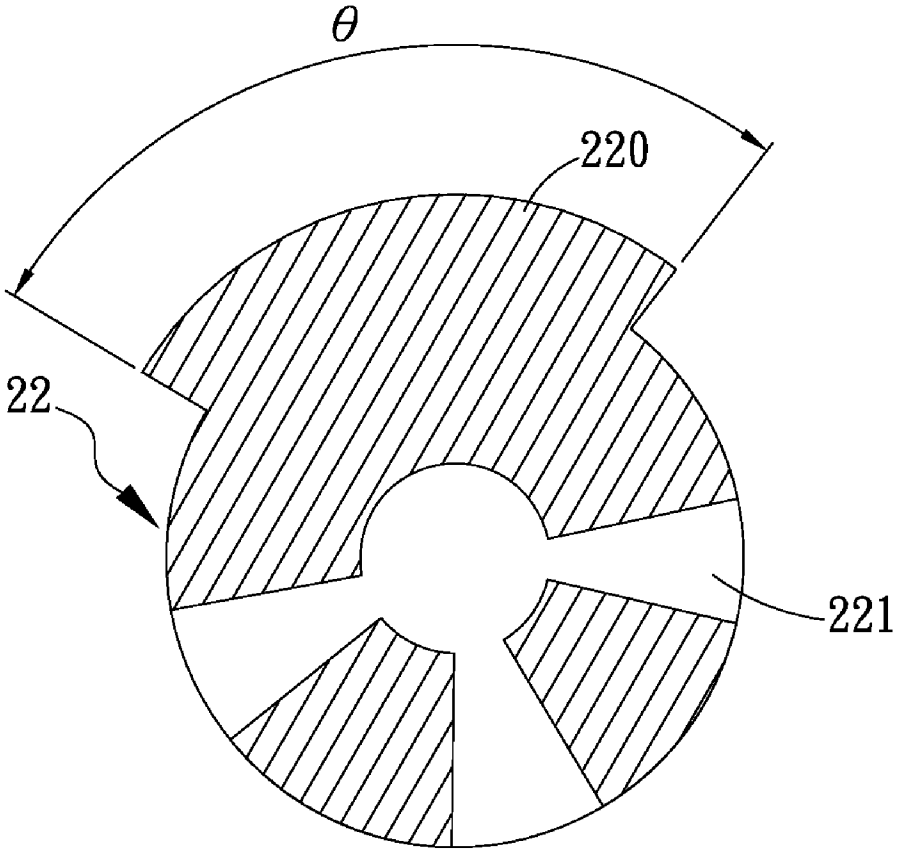
FIG. 4 is a cross sectional view of an inner wheel being adopted in the suction roller according to an exemplary embodiment of the invention.
Figure 5A:
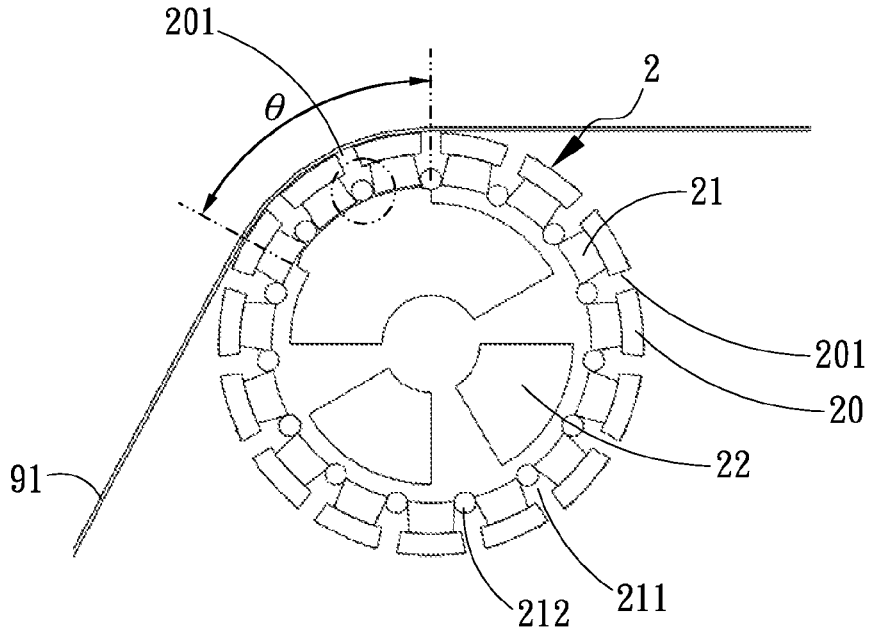
FIG. 5A and FIG. 5B are schematic diagrams showing how the valve in the suction roller is operating according to an exemplary embodiment of the invention.
Figure 5B:
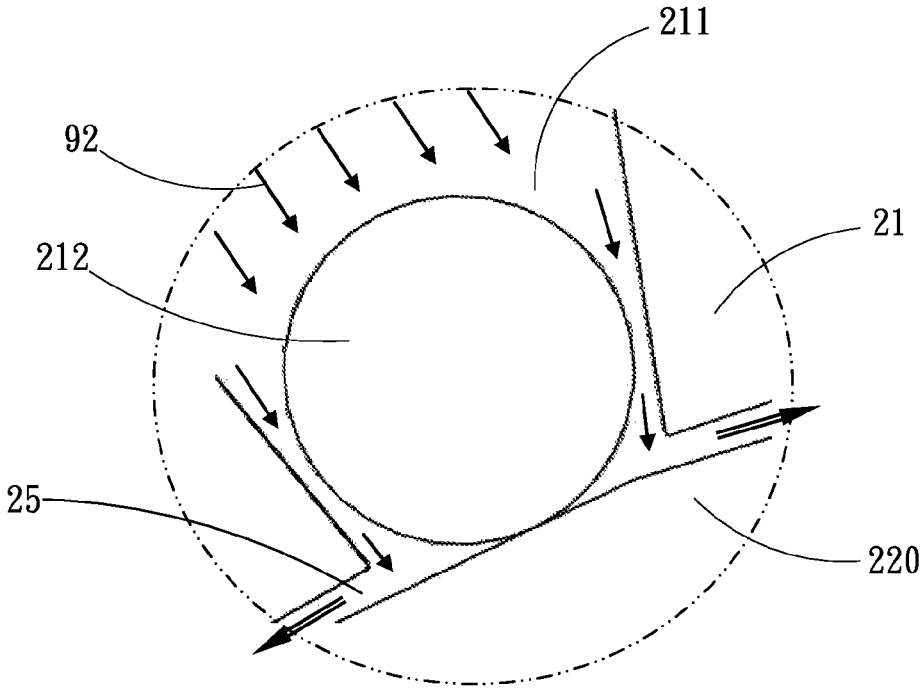

As shown in FIG. 1A and FIG. 1B, the inner wheel 22, which is received inside the accommodation space 213 of the outer wheel 21, is configured with a protrusion 220 and at least a slot 221. The protrusion 220 is separated from the inner wall of the outer wheel 21 by a minute gap 25, as shown in FIG. 5B. In the embodiment shown in FIG. 4, the protrusion 220 is designed with a developing angle θ which is an angle ranged between 10 degrees and 180 degrees. It is noted that the range of the suction that the suction roller is capable of generating and exerting on the object is dependent upon the developing angle.

As shown in FIG. 1A and FIG. 1B, the inner wheel 22 is attached to two tubes 222 respectively at the two ends thereof as each tube 222 is ensheathed by a bearing 26. The inner wall 260 of each bearing 26 is designed matching with the outer wall of its corresponding tube 222 while the outer wall 261 of the bearing 26 is designed matching with the inner wall 214 of the outer wheel 21, by that the outer wheel 21 is rotatable against the bearings 26. In addition, the tubes are further ensheathed respectively by oil seal components 27 which are disposed outside the bearings 26. Each of the two lateral sides of the inner wheel 22 is covered by a cap 28 to be used for fixedly securing the bearings 26 and the oil seal components 27 to the outer wheel 21. It is noted that the outer diameter of the cap 28 is about equal to that of the sleeve 20. Moreover, there are pipes 23 being coupled respectively to the two ends of the suction roller 2 in a manner that each pipe 23 is channel with a corresponding tube 22 of the inner wheel 22 by one end thereof while connecting another end thereof to a negative pressure source 24. Thereby, through the slot 221 of the inner wheel 22, the negative pressure of the negative pressure source 24 can work on the valves 212 inside any second via holes which are capable of communicating with the inner wheel 22. It is noted that by the suction roller design shown in FIG. 1A and FIG. 2B, the leakage problem between the outer wheel 21 and the inner wheel 22 can be improved. By the formation of the second via holes 211 on the outer wheel 21 and the valves 212 of specific shapes fitted inside the second via holes 211, the on-off of the valves 212 can be controlled effectively by the negative pressure of the negative pressure source 24 exerting through the inner wheel 22 so that the sucking force of the suction roller capable of exerting on the object that is being transported thereby is improved as the air flow generated by the negative pressure can be controlled effectively.

With regard to the assembly of the suction roller shown in FIG. 1A and FIG. 1B, it is performed first by insetting the inner wheel 22 inside the outer wheel 21 while connecting the negative pressure source 24 to the two lateral sides of the inner wheel 22 for enabling the outer wheel 21 to exert suction through the negative pressure of its second via holes 211. Then, the outer wheel 21 is placed into a container having a plurality of valves stored therein and is being driven to rotate, so that during the rotation, by the suction caused from the negative pressure through each second via hole 211, there will be a valve 212 being sucked into its corresponding second via hole 211. Thereafter, the outer wheel 21 is being received inside the thermal-expanded sleeve 20 and thus can be tightly fitted inside the sleeve 20 after it is cooled down for completing the suction roller as the one shown in FIG. 1A. However, except for the use of the principle of object expand on heating and contract on cooling for enabling the outer wheel 21 to be tightly fitted inside the sleeve 20, there are other methods capable of achieving the same, e.g. using a high pressure to squeezing the outer wheel 21 into the sleeve 20, or forcing the outer wheel 21 to fit into the sleeve 20 by rotating and pressing the outer wheel 21 at the same time, and so on.

The releasing of the negative pressure through the second via holes by the on-off of the corresponding valves is described in the following description. Please refer to FIG. 5A and FIG. 5B, which are schematic diagrams showing how the valve in the suction roller is operating according to an exemplary embodiment of the invention. First, as the valves 212 are placed into the second via holes 211 of the outer wheel 21, the outer wheel 21 is then being received inside the sleeve 20 for preventing the valves 212 from dropping out when the outer wheel 21 is idle. It is noted that the sleeve 20 is designed to rotate in synchronization with the rotation of the outer wheel 21. As for the inner wheel 22, it is designed to be immobile and only have contact with a portion of the valves 212 on the outer wheel 21 at a time by the protrusion 220 thereof. Before turning on the negative pressure source 24, a layer of flexible substrate 91 is placed on the suction surface of the sleeve 20. As soon as the valves 212 is subjected to the negative pressure from the operating negative pressure source 24 through the inner wheel 22, the valves 212 are drawn by the negative pressure to tightly plug into the second via holes 211 so that the second via holes 211 can be clogged by the valves 212. As shown in FIG. 5A, only those valves 212 that are in contact with the protrusion 220 are pushed by the protrusion 220 so that they will not be drawn into the corresponding second via holes for clogging the same. For those second via holes whose valves 212 are abutted by the protrusion 220, it is possible to allow air 92 to flow from its ambient environment into the inner wheel 22 through those valves 212 and the corresponding second via holes 211, as shown in FIG. 5B. Consequently, a portion of the flexible substrate 91 on the sleeve 20 that is disposed at a position corresponding to second via holes whose valves 212 are pushed by the protrusion 220 will be affected by the negative pressure through the corresponding first via pin holes 201 for generating suction.

Figure 6A:
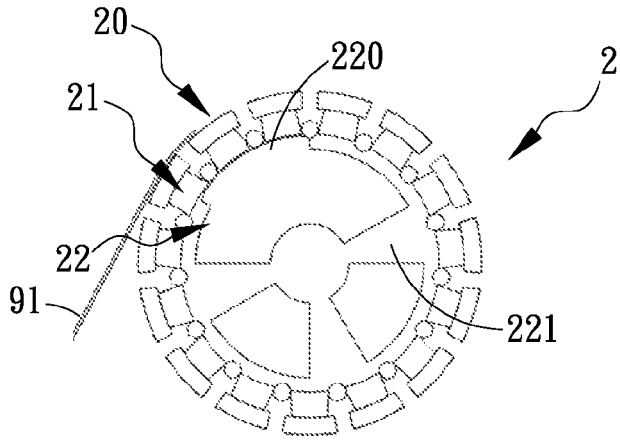
FIG. 6A to FIG. 6C are schematic diagrams showing how step-by-step an object is being transported by the suction roller of the invention.
Figure 6B:
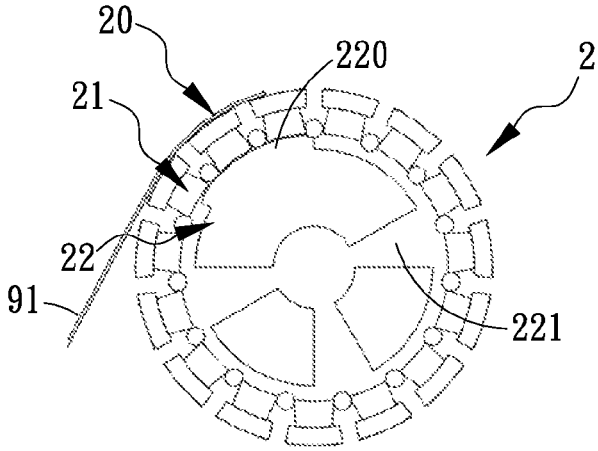
Figure 6C:
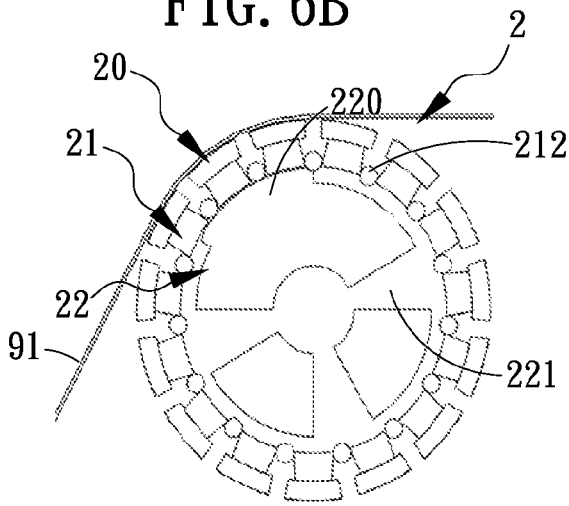

Please refer to FIG. 6A to FIG. 6C, which are schematic diagrams showing how step-by-step an object is being transported by the suction roller of the invention. In FIG. 6A, the flexible substrate 91 is sucked and thus adhered on the surface of the sleeve 20. In FIG. 6B, the valves 212 are rotating with the rotation of the sleeve 20, and during the rotation, they are pushed by the protrusion 220 on the inner wheel 22 sequentially for correspondingly and sequentially declogging the second via holes 211 to allow the formation of air flow and thus generate suction, as those shown in FIG. 5B. Thereby, the flexible substrate 91 that are sucked and adhered on the sleeve 20 can be transported by the rotation of the sleeve 20 following the sequentially declogging of the second via holes 211 during the rotation. In FIG. 6C, as soon as the valves 212 are free from the push of the protrusion 220, they will be drawn by the negative pressure again and thus tightly plugging into the corresponding second via holes 211 for clogging the same so that the flexible substrate 91 that was originally being sucked by the suction through the first via pin holes 201 corresponding to those newly clogged second via holes 211 are released. Accordingly, as the flexible substrate 91 are sucked and adhered on the suction roller 2 at position corresponding to the protrusion 220, it can be transported forward by the rotation of the suction roller 2 following the sequentially unclogging of the second via holes 211 during the rotation.

Figure 7A:
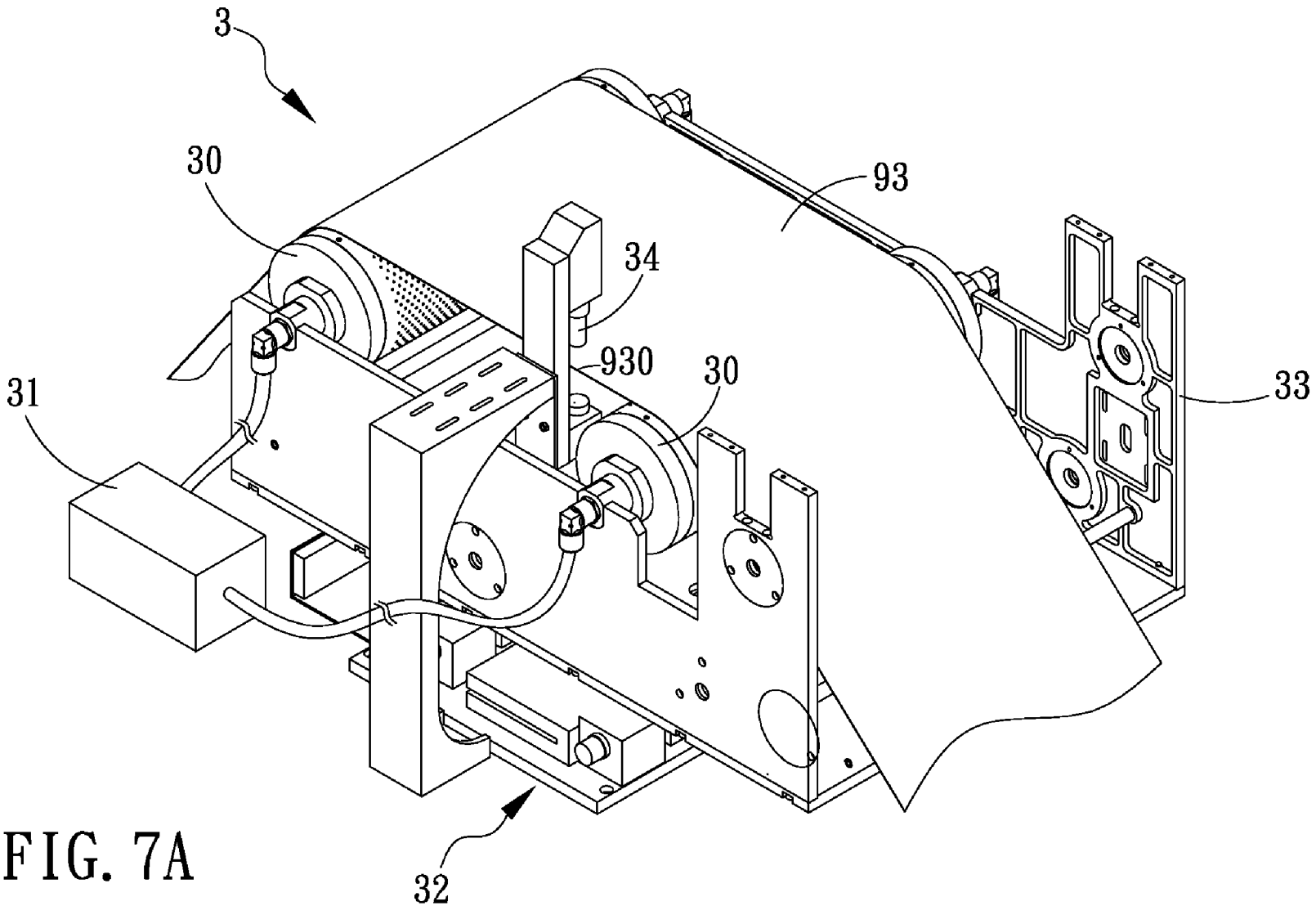
FIG. 7A is a schematic diagram showing a transporting apparatus according to an exemplary embodiment of the invention.

Please refer to FIG. 7A, which is a schematic diagram showing a transporting apparatus according to an exemplary embodiment of the invention. In this exemplary embodiment, the transporting apparatus 3 comprises: a pair of suction rollers 30, a negative pressure source 31 and a position adjusting unit 32. The two suction rollers 30 are mounted on a base 33 to be used for transporting an object 93. The object can be a soft substrate or a flexible substrate, in other words, e.g., a plastic substrate or other substrates made of polymer materials, but is not limited thereby. In this embodiment, each of the two suction rollers 30 are structured the same as the one described hereinbefore and thus is not described further herein.

The negative pressure source 31 is coupled to the pair of suction rollers 30 by pipes for providing a negative pressure thereto. The position adjustment unit 32 is coupled to the base 33 for adjusting the position thereof and thus compensating the shifting during the transporting of the object 93. In this embodiment, the position adjusting unit 32 can be a linear motor of high precision, which is capable of enabling a translation motion for adjusting the position of the object 93 so that any shifting of the object 93 caused by the transportation can be compensated. The linear motor is configured with a controller and a guide rail that the use of the controller for receiving control signals and then controlling the guide rail to move accordingly is known to those skilled in the art and thus is not described further herein. Moreover, there is at least a position sensor 34 for detecting a position relating to a lateral side 930 of the object 93. The position adjusting unit 32 is designed to base upon the shifting of the lateral side 930 detected by the position sensor 34 to program a precise translation motion for compensating the shifting of the object 93. The location as well as the amount of the position sensor being configured in the transporting apparatus 3 are determined according to actual requirement and are not limited by those shown in FIG. 7A.

Figure 7B:
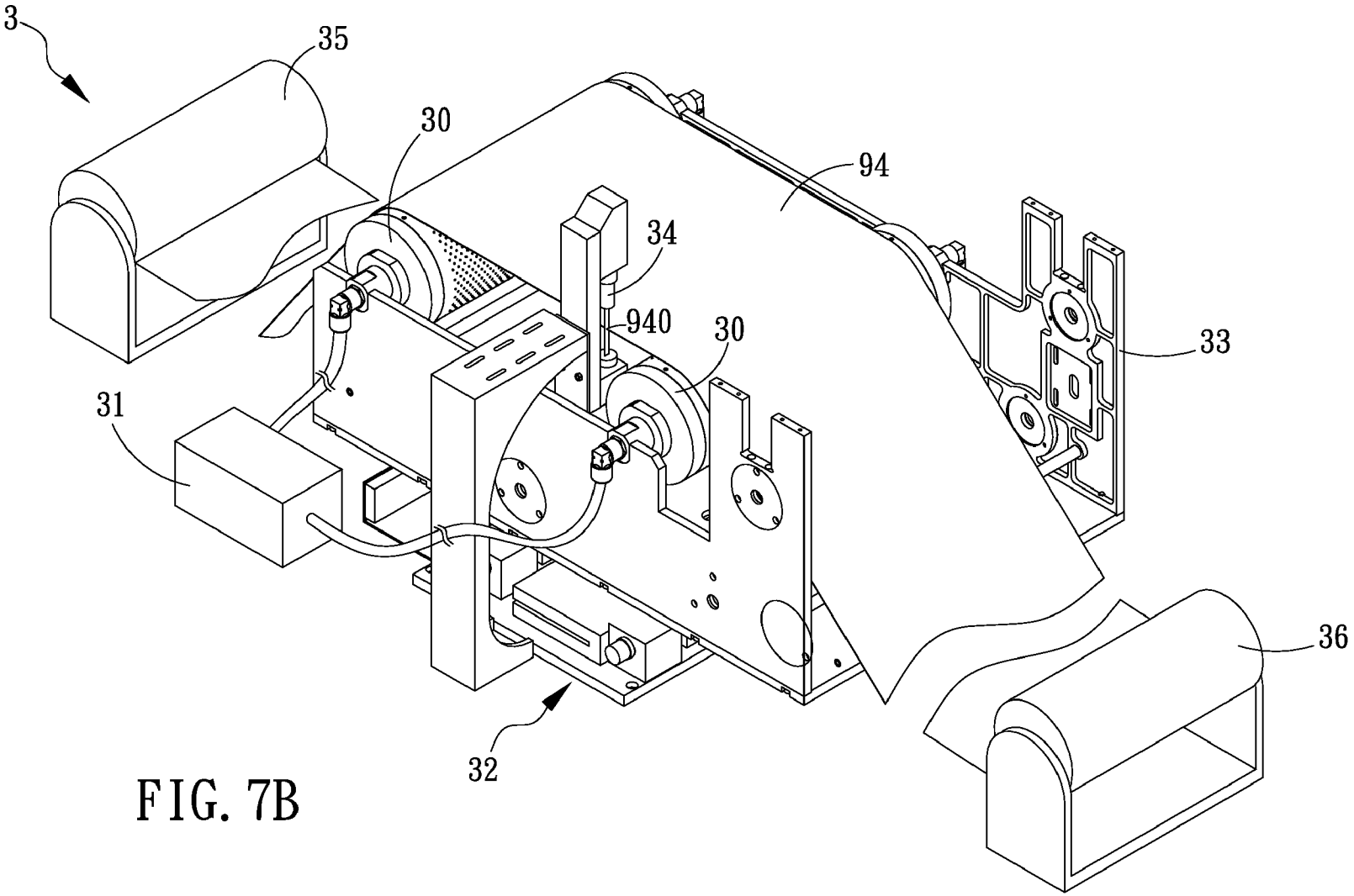
FIG. 7B is a schematic diagram showing a transporting apparatus according to another exemplary embodiment of the invention.

Please refer to FIG. 7B, which is a schematic diagram showing a transporting apparatus according to another exemplary embodiment of the invention. The transporting apparatus shown in FIG. 7B is basically the same as that shown in FIG. 7A, but is different in that: the transporting apparatus 3 of FIG. 7B is configured with an unwind roller section 35 and a wind roller section 36. The unwind roller section 35 is used for carrying a flexible object and the wind roller section 36 is used for receiving and rolling up those flexible object after being processed by the transporting apparatus 3. As the transporting apparatus 3 of FIG. 7B is substantially a roll-to-roll device, the flexible object 94 is going to be processed by procedures such as coating and medium filling during the transportation. However, before the processed flexible object 94 is cured, any pressing or rolling against the surface of the flexible object 94 should be avoided for preventing damages. Thus, for preventing the processed surface of the flexible substrate from being damaged by the pressing of rollers, the transporting apparatus 3 adopts the aforesaid suction rollers for transporting the flexible object 94.

In addition, for compensating the shifting of the flexible object 94 as it is being sucked to transport by the suction rollers 30, there are position sensors being configured in the transporting apparatus 3 for detecting a position relating to a lateral side 940 of the object 94, by that any shifting of the object 94 can be detected. That is, as soon as a shifting occurs during the transporting of the flexible object 94, the amount of shifting relating to the lateral side 940 can be sampled and detected by the position sensor 34 and then the sampled signal is sent to the linear motor controller in the position adjusting unit 32 for controlling the controller to direct the motor for performing a position correction operation.

Although the embodiments of FIG. 7A and FIG. 7B both being configured with a pair of suction rollers, it is known to those skilled in the art that it is feasible to have a transporting apparatus with only a single suction roller simply by integrating the suction roller 2 of FIG. 1 with the position sensor 34 and position adjusting unit 32 of FIG. 7A and FIG. 7B. Moreover, the suction roller and its transporting apparatus can be used in various applications, which not only it can be used for transporting flexible components such as flexible display and flexible PCBs, but it also can be used in product packaging, product transportation, and so on.

Figure 8A:
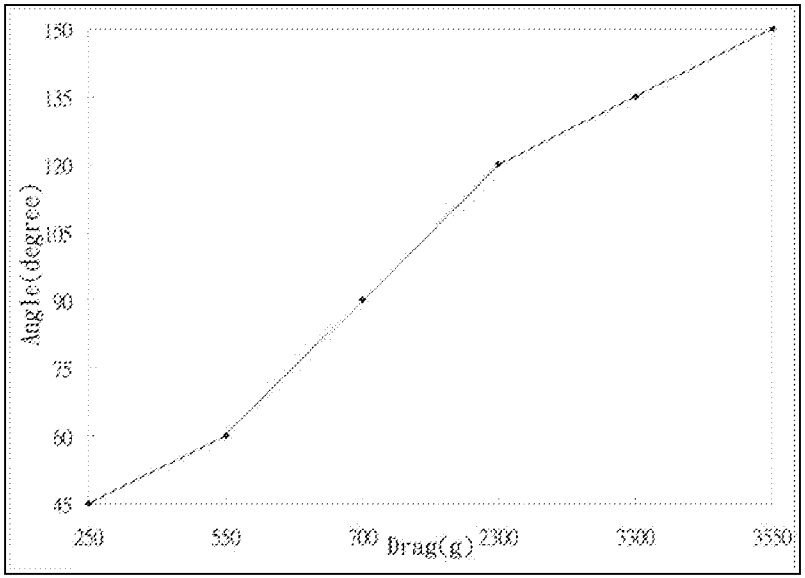
FIG. 8A is a diagram profiling the performance of a conventional suction roller disclosed in U.S. Pat. No. 6,427,941.
Figure 8B:
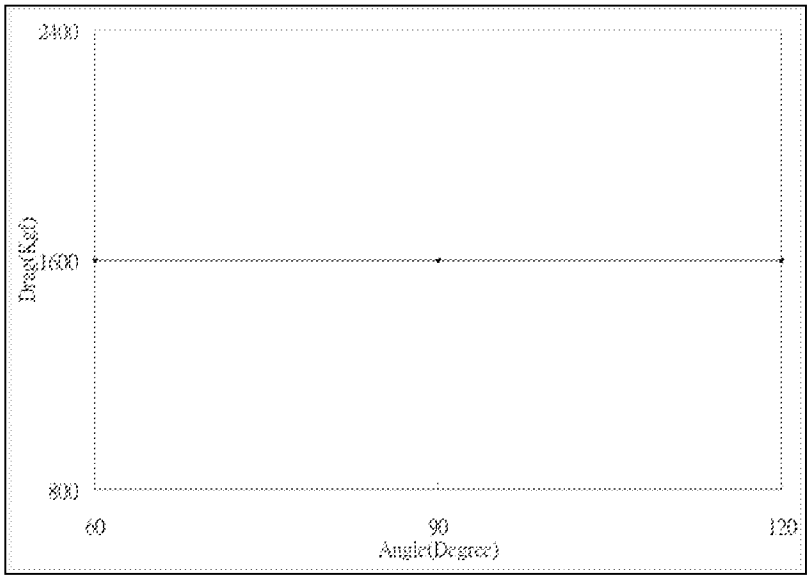
FIG. 8B is a diagram profiling the performance of a suction roller of the invention.

Please refer to FIG. 8A and FIG. 8B, which are diagrams respectively profiling the performance of a conventional suction roller disclosed in U.S. Pat. No. 6,427,941 and the performance of a suction roller of the invention. In the FIG. 8A and FIG. 8B, the coordinate of angle represents the range of angle within which the suction roller is exerting a suction upon the object, and the coordinate of drag represents the magnitude of drag required for pulling the object as the object is being adhered by the suction of the suction roller under certain range of angle. From the profile of FIG. 8A, it is noted that the suction generated from the conventional suction roller is not stable, that is, the smaller the contact angle the smaller the suction will be, and vice versa. The reasoning for that is because there might be leakage in the conventional suction roller so that the suction is changing along with the contact area. On the other hand, as shown in FIG. 8B, since there is no leakage in the suction roller of the invention, such suction roller of the invention is able to exert a stable suction on the object at any contact area.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A suction roller, comprising:

a sleeve, having a plurality of first via holes formed thereon;

an outer wheel, being received inside the sleeve, having a plurality of second via holes formed thereon at positions corresponding to the plurality of first via holes while configuring a valve inside each second via hole; and an inner wheel, being received inside the outer wheel and configured with a protrusion and at least a slot in a manner that the protrusion is separated from an inner wall of the outer wheel by a minute gap.

2. The suction roller of claim 1, wherein the protrusion is configured with a developing angle, ranged between 10 degrees and 180 degrees.

3. The suction roller of claim 1, wherein each of the first via holes is a circular-shaped hole.

4. The suction roller of claim 1, wherein each of the second via holes is a cone-shaped hole.

5. The suction roller of claim 1, wherein the valve is a formed as a shape selected from the group consisting of: a ball, a cone and a column.

6. The suction roller of claim 1, wherein the valve is made of a material selected from the group consisting of: steel, glass, ceramics, fibers and plastics.

7. The suction roller of claim 1, wherein the sleeve is made of a material selected from the group consisting of: steel, glass, ceramics, fibers and plastics.

8. The suction roller of claim 1, wherein the inner wheel is coupled to a negative pressure source by at least an end thereof for enabling the valves to be subjected to the negative pressure from the negative pressure source through the at least one slot.

9. The suction roller of claim 1, wherein each of the first via holes is an elongated hole.

10. The suction roller of claim 1, wherein each of the second via holes is an elongated cone-shaped hole.

11. The suction roller of claim 1, wherein the inner wheel is attached to two tubes respectively at the two ends thereof as each tube is ensheathed by a bearing and an oil seal component, and each of the two lateral sides of the inner wheel is covered by a cap to be used for fixedly securing the bearing and the oil seal component to the outer wheel.

12. A transporting apparatus, comprising:

at least a suction roller, each being mounted on a base to be used for transporting an object while each further being comprised of:

a sleeve, having a plurality of first via holes formed thereon;

an outer wheel, being received inside the sleeve, having a plurality of second via holes formed thereon at positions corresponding to the plurality of first via holes while configuring a valve inside each second via hole; and an inner wheel, being received inside the outer wheel and configured with a protrusion and at least a slot in a manner that the protrusion is separated from an inner wall of the outer wheel by a minute gap;

a negative pressure source, coupled to the at least one suction roller for providing a negative pressure thereto; and a position adjustment unit, coupled to the base for adjusting the position thereof and thus compensating a shifting during the transporting of the object.

13. The transporting apparatus of claim 12, wherein the protrusion is configured with a developing angle, ranged between 10 degrees and 180 degrees.

14. The transporting apparatus of claim 12, wherein each of the first via holes is a circular-shaped hole.

15. The transporting apparatus of claim 12, wherein each of the second via holes is a cone-shaped hole.

16. The transporting apparatus of claim 12, wherein the valve is a formed as a shape selected from the group consisting of: a ball, a cone and a column.

17. The transporting apparatus of claim 12, wherein the valve is made of a material selected from the group consisting of: steel, glass, ceramics, fibers and plastics.

18. The transporting apparatus of claim 12, wherein the sleeve is made of a material selected from the group consisting of: steel, glass, ceramics, fibers and plastics.

19. The transporting apparatus of claim 12, wherein the inner wheel is coupled to the negative pressure source by at least an end thereof for enabling the valves to be subjected to the negative pressure from the negative pressure source through the at least one slot.

20. The transporting apparatus of claim 12, wherein each of the first via holes is an elongated hole.

21. The transporting apparatus of claim 12, wherein each of the second via holes is an elongated cone-shaped hole.

22. The transporting apparatus of claim 12, further comprising:

at least a position sensor, each for detecting a position relating to a lateral side of the object.

23. The transporting apparatus of claim 12, wherein the position adjusting unit is capable of enabling a translation motion for adjusting the position of the object.

24. The transporting apparatus of claim 12, wherein the object is made of a material selected form the group consisting of: a soft material and a flexible material.

25. The transporting apparatus of claim 23, further comprising an unwind roller section and a wind roller section.

26. The transporting apparatus of claim 12, wherein the inner wheel is attached to two tubes respectively at the two ends thereof as each tube is ensheathed by a bearing and an oil seal component, and each of the two lateral sides of the inner wheel is covered by a cap to be used for fixedly securing the bearing and the oil seal component to the outer wheel.

27. A suction roller, comprising:

a sleeve, having a plurality of first via holes formed thereon;

an outer wheel, being received inside the sleeve, having a plurality of second via holes formed thereon at positions corresponding to the plurality of first via holes, each second hole having a valve therein; and an inner wheel, being received inside the outer wheel and being configured with a protrusion that is separated from an inner circumferential wall of the outer wheel by a minute gap, the protrusion activating respective ones of the valves to open and allow corresponding second via holes disposed adjacent to the minute gap to communicate with the minute gap, while respective other ones of the valves close corresponding other second via holes disposed away from the minute gap.

* * * * *